US009617694B2

(12) United States Patent
Shaw

(10) Patent No.: US 9,617,694 B2
(45) Date of Patent: Apr. 11, 2017

(54) CONCRETE DOWEL SYSTEM

(71) Applicant: SHAW & SONS, INC., Costa Mesa, CA (US)

(72) Inventor: Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

(21) Appl. No.: 14/959,404

(22) Filed: Dec. 4, 2015

(65) Prior Publication Data

US 2016/0083914 A1 Mar. 24, 2016

Related U.S. Application Data

(63) Continuation of application No. 14/156,098, filed on Jan. 15, 2014.

(51) Int. Cl.
*E01C 11/14* (2006.01)
*E01C 19/50* (2006.01)
(Continued)

(52) U.S. Cl.
CPC ..... *E01C 11/14* (2013.01); *E01C 19/504* (2013.01); *E04B 1/48* (2013.01); *E04G 17/06* (2013.01)

(58) Field of Classification Search
CPC ..... E01C 11/14; E01C 23/045
(Continued)

(56) References Cited

U.S. PATENT DOCUMENTS 754,215 A 3/1904 Hayward
1,045,562 A 11/1912 Kennedy
(Continued)

FOREIGN PATENT DOCUMENTS

CH 568457 10/1975
DK 52370 11/1936
(Continued)

OTHER PUBLICATIONS

John P. Broomfield, "Corrosion of Steel in Concrete", E&FN Spon, 3 pgs.
(Continued)

*Primary Examiner* — Matthew D. Troutman
(74) *Attorney, Agent, or Firm* — Stetina Brunda Garred and Brucker

(57) ABSTRACT

A dowel placement system including a fastener configured to be engageable with a form, and a radially compressible bushing coupled to the fastener and defining an adjustable outer diameter. The system further includes an elongate dowel sleeve having opposed proximal and distal end portions, and an axial opening having an inner diameter and extending into the dowel sleeve from the proximal end portion to the distal end portion. The bushing is insertable within the axial opening of the dowel sleeve, and the bushing and dowel sleeve are configured such that insertion of the bushing within the dowel sleeve causes the outer diameter of the bushing to compress and conform to the inner diameter of the dowel sleeve and to create a friction force between the bushing and the dowel sleeve to mitigate movement of the dowel sleeve relative to the bushing during formation of the concrete structure.

2 Claims, 4 Drawing Sheets

(51) Int. Cl.
*E04B 1/48* (2006.01)
*E04G 17/06* (2006.01)

(58) Field of Classification Search
USPC ..... 404/88
See application file for complete search history.

(56) References Cited

U.S. PATENT DOCUMENTS

| | | | | |
|---|---|---|---|---|
| 1,545,267 | A | 7/1925 | Marge | |
| 1,592,681 | A | 7/1926 | Grothe | |
| 1,699,557 | A | 1/1929 | Yeager | |
| 1,728,936 | A | 9/1929 | Johnson | |
| 1,755,219 | A | 4/1930 | Knox | |
| 1,767,575 | A | 6/1930 | Bujack | |
| 1,826,062 | A | 10/1931 | Farmer | |
| 1,838,635 | A | 12/1931 | Pilj | |
| 1,852,673 | A | 4/1932 | Pilj | |
| 1,939,007 | A | 12/1933 | Heltzel | |
| 1,942,494 | A | 1/1934 | Robertson | |
| 1,953,846 | A | 4/1934 | Briggs | |
| 2,095,060 | A | 10/1937 | Geyer | |
| 2,096,702 | A | 10/1937 | Yeoman | |
| 2,108,107 | A | 2/1938 | De Wees | |
| 2,110,738 | A * | 3/1938 | Parker | E01C 11/14 404/60 |
| 2,129,568 | A | 9/1938 | De Biasi | |
| 2,166,220 | A | 7/1939 | Older | |
| 2,181,005 | A | 11/1939 | Westcott | |
| 2,262,704 | A | 11/1941 | Tompkins et al. | |
| 2,269,703 | A | 1/1942 | Bagwill | |
| 2,275,272 | A | 3/1942 | Scripture, Jr. | |
| 2,277,203 | A | 3/1942 | Boult | |
| 2,296,453 | A | 9/1942 | Saffert | |
| 2,319,526 | A | 5/1943 | Wearn | |
| 2,331,949 | A | 10/1943 | Whiteman | |
| 2,365,550 | A | 12/1944 | Heltzel | |
| 2,373,284 | A | 4/1945 | Autrey | |
| 2,508,443 | A | 5/1950 | Carter | |
| 2,551,826 | A | 5/1951 | Cox, Sr. | |
| 2,636,426 | A | 4/1953 | Heltzel | |
| 2,746,365 | A | 5/1956 | Darneille | |
| 2,823,539 | A | 2/1958 | Kersh et al. | |
| 2,902,742 | A * | 9/1959 | Matich | E01C 11/14 249/3 |
| 2,980,215 | A | 4/1961 | Englund | |
| 3,066,448 | A | 12/1962 | Pinter | |
| 3,279,335 | A | 10/1966 | Garner | |
| 3,284,973 | A | 11/1966 | Ames et al. | |
| 3,318,224 | A | 5/1967 | Bohanon | |
| 3,333,380 | A | 8/1967 | Wolf | |
| 3,437,017 | A | 4/1969 | Walz | |
| 3,451,179 | A | 6/1969 | Kendzia | |
| 3,527,486 | A | 9/1970 | Gamp | |
| 1,631,576 | A | 6/1972 | Bowers | |
| D229,538 | S | 12/1973 | Steffan | |
| 3,896,599 | A | 7/1975 | Werstein et al. | |
| 3,920,221 | A | 11/1975 | Berry et al. | |
| 3,921,356 | A | 11/1975 | Hughes | |
| 4,077,177 | A | 3/1978 | Boothroyd et al. | |
| 4,087,072 | A | 5/1978 | Olsen | |
| 4,115,976 | A | 9/1978 | Rohrer | |
| 4,146,599 | A | 3/1979 | Lanzetta | |
| 4,158,937 | A | 6/1979 | Henry | |
| D257,503 | S | 11/1980 | McKee | |
| 4,252,767 | A | 2/1981 | Piazza et al. | |
| 4,261,496 | A | 4/1981 | Mareydt et al. | |
| 4,281,496 | A | 8/1981 | Danielsson | |
| 4,329,080 | A | 5/1982 | Elley | |
| D272,517 | S | 2/1984 | Koehn | |
| 4,437,828 | A | 3/1984 | Egger | |
| 4,449,844 | A | 5/1984 | Larsen | |
| 4,493,584 | A | 1/1985 | Guntert | |
| 4,496,504 | A | 1/1985 | Steenson et al. | |
| 4,533,112 | A | 8/1985 | Santos, Jr. et al. | |
| 4,578,916 | A | 4/1986 | Witschi | |
| 4,614,070 | A | 9/1986 | Idland | |
| 4,648,739 | A | 3/1987 | Thomsen | |
| 4,657,430 | A | 4/1987 | Marionneaux | |
| 4,726,561 | A | 2/1988 | Worzala, Jr. | |
| 4,748,788 | A | 6/1988 | Shaw et al. | |
| 4,752,153 | A | 6/1988 | Miller | |
| 4,800,702 | A | 1/1989 | Wheeler | |
| 4,801,425 | A | 1/1989 | Michel et al. | |
| 4,821,988 | A | 4/1989 | Jimenez | |
| 4,883,385 | A | 11/1989 | Kaler | |
| 4,899,497 | A | 2/1990 | Madl, Jr. | |
| 4,926,593 | A | 5/1990 | Johnston | |
| D309,280 | S | 7/1990 | Balfanz-Lee | |
| 4,938,631 | A | 7/1990 | Maechtle et al. | |
| 4,959,940 | A | 10/1990 | Witschi | |
| D314,325 | S | 2/1991 | Ziaylek, Jr. et al. | |
| 4,996,816 | A | 3/1991 | Wiebe | |
| 5,005,331 | A | 4/1991 | Shaw et al. | |
| 5,046,898 | A | 9/1991 | McKinney | |
| 5,096,155 | A | 3/1992 | Fitzgerald | |
| 5,134,828 | A | 8/1992 | Bauer | |
| 5,205,942 | A | 4/1993 | Fitzgerald | |
| 5,212,919 | A | 5/1993 | Shaw et al. | |
| 5,216,862 | A | 6/1993 | Shaw et al. | |
| 5,301,485 | A | 4/1994 | Shaw et al. | |
| D363,211 | S | 10/1995 | Noble | |
| 5,487,249 | A | 1/1996 | Shaw et al. | |
| D375,599 | S | 11/1996 | Hirano et al. | |
| D375,600 | S | 11/1996 | Hirano et al. | |
| 5,618,125 | A | 4/1997 | McPhee et al. | |
| 5,678,952 | A | 10/1997 | Shaw et al. | |
| 5,694,730 | A | 12/1997 | Del Rincon et al. | |
| 5,713,174 | A | 2/1998 | Kramer | |
| 5,797,231 | A | 8/1998 | Kramer | |
| 5,934,821 | A | 8/1999 | Shaw et al. | |
| D419,700 | S | 1/2000 | Shaw et al. | |
| 6,018,833 | A | 2/2000 | Imm | |
| 6,123,485 | A | 9/2000 | Mirmiran et al. | |
| 6,210,070 | B1 | 4/2001 | Shaw et al. | |
| 6,243,994 | B1 | 6/2001 | Bernini | |
| 6,354,053 | B1 | 3/2002 | Kerrels | |
| 6,354,760 | B1 | 3/2002 | Boxall et al. | |
| D459,205 | S | 6/2002 | Shaw et al. | |
| 6,502,359 | B1 | 1/2003 | Rambo | |
| 6,517,277 | B2 | 2/2003 | Hu et al. | |
| 6,655,869 | B1 | 12/2003 | Deeb et al. | |
| 6,926,463 | B2 | 8/2005 | Shaw et al. | |
| 7,004,443 | B2 | 2/2006 | Bennett | |
| 7,314,333 | B2 | 1/2008 | Shaw et al. | |
| 7,338,230 | B2 | 3/2008 | Shaw et al. | |
| 7,381,008 | B2 | 6/2008 | Shaw et al. | |
| 7,604,432 | B2 | 10/2009 | Shaw et al. | |
| 7,874,762 | B2 | 1/2011 | Shaw et al. | |
| 8,007,199 | B2 | 8/2011 | Shaw et al. | |
| 2005/0265802 | A1 | 12/2005 | Miller et al. | |
| 2007/0134063 | A1 * | 6/2007 | Shaw | E01C 11/14 404/62 |

FOREIGN PATENT DOCUMENTS

| | | |
|---|---|---|
| EP | 1123443 | 2/2004 |
| EP | 1389648 | 2/2004 |
| FR | 1094449 | 5/1955 |
| WO | WO0023653 | 4/2000 |

OTHER PUBLICATIONS www.pna-inc.com, "The Diamond Dowel System", 2 pgs.
www.pavement.com, "Load Transfer", 2 pgs.
www.danley.com.au. "Danley Diamond Dowel System", 2 pgs.
Wayne W. Walker and Jerry A. Holland, "Plate Dowels for Slabs on Ground", 4 pgs.

* cited by examiner

CONCRETE DOWEL SYSTEM

CROSS-REFERENCE TO RELATED APPLICATIONS

This is a continuation patent application of U.S. patent application Ser. No. 14/156,098 filed Jan. 15, 2014, the entirety of which are expressly incorporated herein by reference.

STATEMENT RE: FEDERALLY SPONSORED RESEARCH/DEVELOPMENT

Not Applicable

BACKGROUND

1. Technical Field

The present disclosure generally relates to concrete construction, and more specifically to a dowel placement system for facilitating the placement of a slip dowel rod within adjacent concrete slabs.

2. Related Art

In the concrete construction arts, "cold joints" between two or more poured concrete slabs are frequently used for the paving of sidewalks, driveways, roads, and flooring in buildings. Such cold joints frequently become uneven or buckled due to normal thermal expansion and contraction of the concrete and/or compaction of the aggregate caused by inadequate preparation prior to pouring of concrete. As a means of preventing bucking or angular displacement of such cold joints, it is common practice to insert smooth steel dowel rods generally known as "slip dowels" within the edge portions of adjacent concrete slabs in such a matter that the concrete slabs may slide freely along one or more of the slip dowels, permitting linear expansion and contraction of the slabs while also maintaining the slabs in a common plane and thus preventing undesirable bucking or unevenness of the cold joint.

Typically, in order to function effectively, slip dowels must be accurately positioned parallel within the adjoining concrete slabs. The non-parallel positioning of the dowels will generally prevent the desired slippage of the dowels and will defeat the purpose of the "slip dowel" application. Additionally, the individual dowels must be generally placed within one or both of the slabs in such a manner as to permit continual slippage or movement of the dowels within the cured concrete slab(s).

A number of methods of installing smooth slip dowels are known in the art. According to one method, a first concrete pour is made within a pre-existing form. After the first pour has hardened, an edge of the form, usually a wooden stud, is stripped away. A series of holes are then drilled parallel into the first pour along the exposed edge from which the form has been removed. The depth and diameter of the individual holes varies depending on the application and the relative size of the concrete slabs to be supported. As a general rule, however, such holes are at least twelve inches deep and typically have a diameter of approximately five-eighths (⅝) of an inch.

After the parallel series of holes have been drilled into the first pour, smooth dowel rods are advanced into each hole such that one end of each dowel rod is positioned within the first pour and the remainder of each dowel rod extends into an adjacent area where a second slab of concrete is to be poured. Thereafter, concrete is poured into such adjacent area and is permitted to set with the generally parallel aligned dowels extending thereto. After the second pour has cured, the slip dowels will be held firmly within the second slab, but will be permitted to slide longitudinally within the drilled holes of the first slab thereby accommodating longitudinal expansion and contraction of the two slabs while at the same time preventing buckling or angular movement therebetween.

Although the above-described "drilling method" of placing slip dowels is popular, it will be appreciated that such method tends to be extremely labor intensive. In fact, it typically takes approximately ten minutes to drill a five eighths inch (⅝") diameter by twelve inch long hole into the first pour and the drilling equipment, bits, accessories, and associated set up time tends to be very expensive. Moreover, the laborers who drill the holes and place the slip dowels must be adequately trained to ensure that the dowels are arranged perpendicular to the joint but parallel to one another so as to permit the desired slippage.

Another popular method of placing slip dowels involves the use of wax-treated cardboard sleeves positioned over one end of each individual dowel. According to such method, a series of holes are drilled through one edge of the concrete form and smooth dowels are advanced through each such hole. Thereafter, the treated cardboard sleeves are placed over one end of each dowel, with a first pour subsequently being made within the form which covers the ends of the dowels including the cardboard sleeves thereon. After the first pour has set, the previously drilled form is stripped away, leaving the individual dowels extending into a neighboring open space where the second pour is to be made. Subsequently, the second pour is made and cured. Thereafter, the slip dowels will be firmly held by the concrete of the second pour, but will be permitted to longitudinally slide against the inner surfaces of the wax treated cardboard sleeves within the first pour. Thus, the waxed cardboard sleeves facilitate longitudinal slippage of the dowels, while at the same time holding the two concrete slabs in a common plane, and preventing undesirable buckling or angular movement thereof.

This method was also associated with numerous deficiencies, namely, that after the first pour was made, the free ends of the dowels were likely to project as much as eighteen inches through the form and into the open space allowed for the second pour. Because the drilled section of the form must be advanced over those exposed sections of dowel to accomplish stripping or removal of the form, it is not infrequent for the exposed portions of the dowels to become bent and, thus, non-parallel. Additionally, the drilled section of the form became damaged or broken during the removal process, thereby precluding its reuse.

Each of the above described known methods of placing slip dowels between concrete slabs often results in the dowels being finally positioned at various angles rather than in the desired parallel array. Therefore, the necessary slippage of the dowels is impeded or prevented.

In view of these deficiencies, several developments have been made to provide more accurate placement of the slip dowel. Exemplary developments are shown in U.S. Pat. Nos. 5,005,331, 5,216,862, and 7,874,762 all to Shaw et al., and the contents of which are expressly incorporated herein by reference. The developments generally include the use of a dowel sleeve having a flange disposed at an open end thereof to facilitate attachment or engagement with the concrete form. In this regard, the concrete form typically provides direct support to the dowel sleeve.

Although the use of the dowel sleeve typically results in more accurately placed slip dowels, the concrete sleeves tend to be expensive to manufacture, as a result of the excess material required for the attachment/support flange. Furthermore, installation of the dowel sleeve has a tendency to be time consuming as the installer ensures that the flange is properly fastened or supported directly by the concrete form.

Accordingly, there is a need in the art for an inexpensive and easy-to-use dowel positioning device. These needs and more are accomplished with the present novel and inventive device, the details of which are discussed more fully hereunder.

BRIEF SUMMARY

Various aspects of the present invention are directed toward an improved dowel placement system including a dowel sleeve that is formed without a support flange at the open end of the dowel sleeve. In this regard, the dowel sleeve does not engage with the concrete form for purposes of receiving direct support from the concrete form. This configuration allows the dowel sleeve to be formed with less material, thereby reducing the overall cost, as well as to be more easily and quickly installed.

According to one embodiment, there is provided a dowel placement system for placing dowels in a concrete structure fabricated using a form. The dowel placement system includes a fastener configured to be engageable with the form, and a radially compressible bushing coupled to the fastener and defining an adjustable outer diameter. The dowel placement system further includes an elongate dowel sleeve having a proximal end portion, an opposing distal end portion, and an axial opening having an inner diameter and extending into the dowel sleeve from the proximal end portion to the distal end portion. The bushing is insertable within the axial opening of the dowel sleeve, and the bushing and dowel sleeve are configured such that insertion of the bushing within the dowel sleeve causes the outer diameter of the bushing to compress and conform to the inner diameter of the dowel sleeve and to create a friction force between the bushing and the dowel sleeve to mitigate movement of the dowel sleeve relative to the bushing during formation of the concrete structure.

The bushing may include at least one slit formed therein for enabling compression thereof. The at least one slit may extend axially along a length of the bushing. The bushing may be selectively transitional between an expanded configuration and a compressed configuration, wherein the outer diameter decreases as the bushing transitions from the expanded configuration toward the compressed configuration. The bushing may be biased toward the expanded configuration.

The bushing and dowel sleeve may be configured such that the bushing exerts a radial force on the dowel sleeve when the bushing is inserted within the dowel sleeve.

The friction force created between the bushing and the dowel sleeve may mitigate axial and rotational movement of the dowel sleeve relative to the bushing.

The bushing may include an inner sleeve configured to circumferentially engage with the fastener, and an outer sleeve including a plurality of outer sleeve panels. Adjacent ones of the plurality of outer sleeve panels may be separated by a slit. The plurality of outer sleeve panels may be moveable relative to the inner sleeve.

The bushing may be fabricated from a plastic material. The dowel sleeve may be fabricated from a plastic material.

The fastener may include threads for threadably engaging with the form.

The dowel sleeve may be formed independent of a flange at the proximal end portion thereof.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
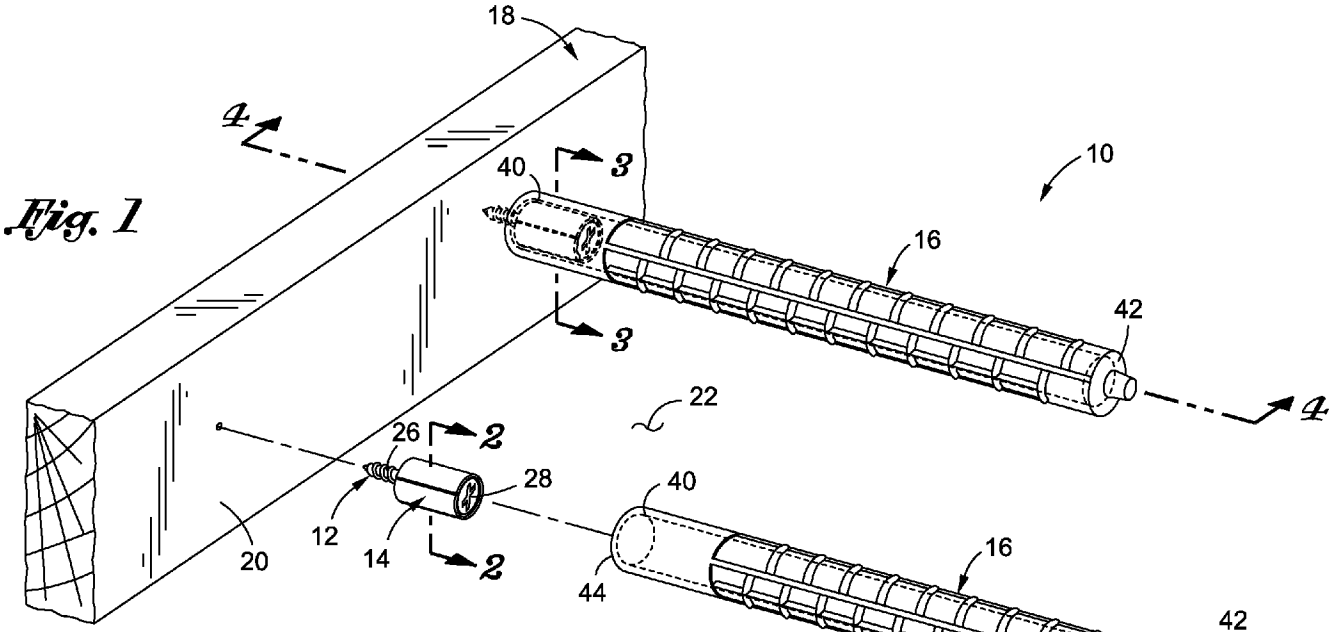
FIG. 1 is an upper perspective view of a dowel placement system constructed in accordance with an embodiment of the present invention.

Referring now to the drawings, wherein the drawings are for purposes of illustrating a preferred embodiment of the present invention only, and are not for purposes of limiting the same, there is depicted a dowel placement system 10 constructed in accordance with an embodiment of the present invention. In general, the dowel placement system 10 includes a fastener 12, a radially-compressible bushing 14, and an elongate dowel sleeve 16. As will be described in more detail below, various aspects of the invention are directed toward creating a suitable friction force between the bushing 14 and the dowel sleeve 16 to maintain the dowel sleeve 16 in a prescribed position while the concrete is poured and hardens. The bushing 14 is radially compressible to allow the bushing 14 to tightly conform to the size of the dowel sleeve opening so as to radially engage the inner wall of the dowel sleeve 16.

Referring now specifically to FIG. 1, there is shown a concrete form 18 used for defining an enclosed area for pouring concrete. The concrete form 18 is preferably fabricated from wood, although other materials known in the art may also be used. The form 18 includes an inner face 20, which faces the concrete pour area 22, and an opposing outer face 24, which faces away from the concrete pour area 22.

The bushing 14 is connected to the form 18 via the fastener 12. According to one embodiment, the fastener 12 includes an elongate shaft portion 26 that is advanceable into the form 18 through the inner face 20. In the exemplary embodiment, the fastener 12 is a screw having an externally threaded shaft portion 26 and an opposing head portion 28 engageable with a screwdriver. It is also contemplated that the fastener 12 may be a nail, rivet or other fastening devices known in the art.

Figure 2:
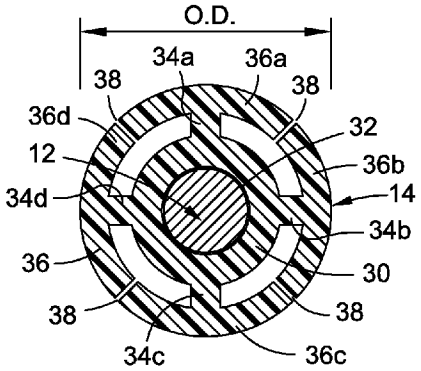
FIG. 2 is a cross sectional view of a bushing in an expanded configuration.

The bushing 14 is coupled to the fastener 12 adjacent the head portion 28, which exposes a length of the elongate shaft portion 26 to allow for advancement thereof into the form 18. Referring now to FIG. 2, the exemplary embodiment of the bushing 14 includes an inner sleeve 30 that defines a bushing opening 32 sized to receive the fastener 12 for circumferentially engaging with the fastener 12. Extending radially outward from the inner sleeve 30 are four arms 34*a-d* which connect the inner sleeve 30 with a respective outer sleeve panel 36*a-d*. The exemplary outer sleeve panels 36*a-d* are arcuate in shape and collectively define an outer sleeve 36 which is co-axially aligned with the inner sleeve 30. The outer sleeve panels 36*a-d* collectively define a bushing outer diameter "O.D."

Each outer sleeve panel 36*a-d* is separated from a corresponding pair of the adjacent panels 36*a-d* by an axial slit 38. The exemplary embodiment includes four axial slits 38 which are evenly spaced about the periphery of the bushing 14 (i.e., at 90° increments). It is contemplated that the bushing may include fewer than four axial slits 38, or more than four axial slits 38 without departing from the spirit and scope of the present invention. Furthermore, although the exemplary slits 38 are axial in nature, it is also understood that other embodiments may include slits that have curved segments. As will be explained in more detail below, the slits 38 are formed in the bushing 14 to allow for adjustment of the bushing outer diameter O.D to conform to the dowel sleeve 16 to create a tight fit between the bushing 14 and the dowel sleeve 16.

The dowel sleeve 16 is elongate and defines a proximal end portion 40 and an opposing distal end portion 42. The proximal end portion 40 terminates to define an end face 44. The dowel sleeve 16 further includes an inner surface 46 extending from the end face 44 about a longitudinal axis to define an axial opening 48 extending into the dowel sleeve 16 from the end face 44 toward the distal end portion 42. The axial opening 48 defines an inner diameter, "I.D."

The inner diameter I.D. is sized to circumferentially engage with the outer surface 36 of the bushing 14 during formation of the concrete structure. The inner diameter I.D. is further configured to accommodate a dowel pin to allow for movement of adjacent concrete slabs, as will be described in more detail below.

The outer surface of the dowel sleeve 16 may be contoured in a wide range of shapes and configurations. For instance, the outer surface may have ribs, ridges, or threads, as shown in the exemplary embodiment, or alternatively, may define a generally smooth contour.

Figure 4:
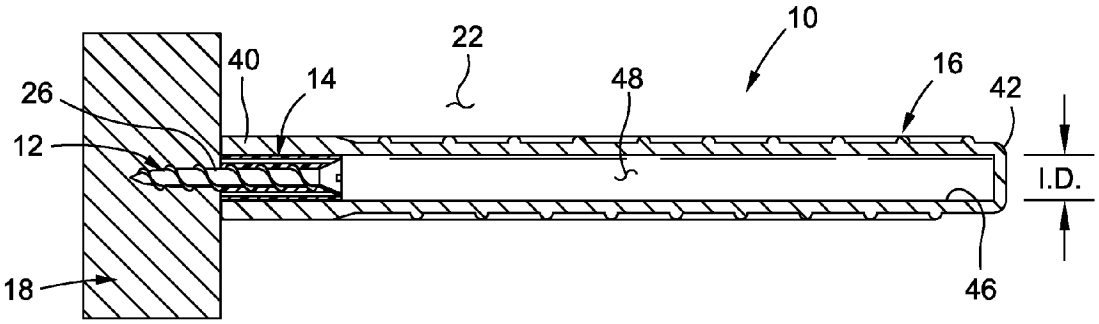
FIG. 4 is a side sectional view of the dowel placement system engaged with a concrete form prior to pouring concrete.
Figure 5:
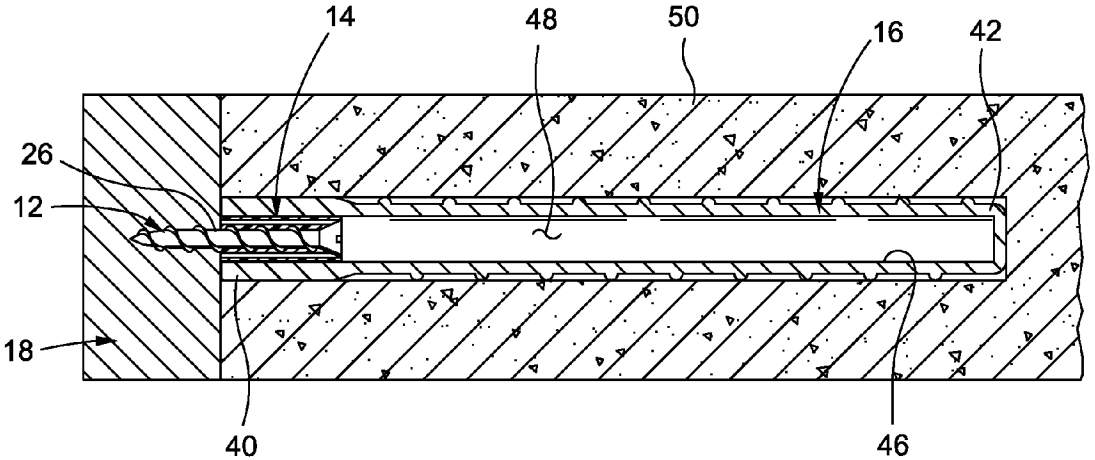
FIG. 5 is a side sectional view of the dowel placement system after concrete is poured, with the dowel sleeve embedded in the concrete.

With the basic structural features described above, use of the dowel placement system 10 will be described below, with reference being made to FIGS. 4-7. Use of the dowel placement system 10 typically begins by connecting the fastener 10 to the form 18. In a preferred implementation, the bushing 14 is already coupled to the fastener 12 before the fastener 12 is coupled to the form 18. As shown in FIG. 4, the fastener 12 is advanced into the form 18 via the inner face 20 thereof. Preferably, the fastener 12 extends into the form 18 until the bushing 14 is brought into abutting contact with the form 18 such that the fastener 12 and bushing 14 extend generally perpendicularly from the inner face 20.

Figure 3:
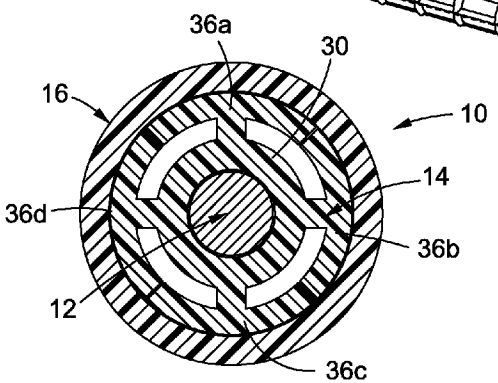
FIG. 3 is a cross sectional view of a dowel sleeve advanced over a bushing, which causes the bushing to transition from the expanded position to a compressed configuration.

With the fastener 12 coupled to the form 18, and the bushing 14 in an expanded configuration, the dowel sleeve 16 is advanced over the bushing 14 with the bushing 14 being received within the axial opening 48 of the dowel sleeve 16. The inner diameter I.D. of the axial opening 48 is slightly smaller than the outer diameter O.D. of the bushing 14 when the bushing 14 is in the expanded configuration. Thus, advancement of the dowel sleeve 16 over the bushing 14 causes the bushing 14 to transition from the expanded configuration to the compressed configuration, wherein the outer diameter O.D. of the bushing 14 is reduced so as to fit within the axial opening 48. FIG. 2 is a cross sectional view of the bushing 14 in the expanded configuration, while FIG. 3 is a cross sectional view of the bushing 14 positioned within dowel sleeve 16 and in the compressed configuration. The presence of the slots 38 within the bushing 14 allows the outer diameter O.D. thereof to be reduced so as to enable insertion of the bushing 14 within the dowel sleeve 16.

The dowel sleeve 16 is preferably advanced over the bushing 14 until the end face 44 of the dowel sleeve 16 is brought into abutting contact with the form 18, although such contact is not required to stabilize or support the dowel sleeve 16 during pouring and hardening of the concrete. Rather, the contact between the dowel sleeve 16 and the form 18 is simply to prevent concrete from flowing therebetween. Moreover, the support and stabilization of the dowel sleeve 16 is preferably provided solely by the bushing 14. Along these lines, the bushing 14 is configured such that the bushing 14 is biased radially outward toward the expanded configuration. Therefore, when the bushing 14 is advanced within the dowel sleeve 16 and transitioned to the compressed configuration, the bushing 14 is urged toward the expanded position, which causes the bushing 14 to impart a force upon the inner surface 46 of the dowel sleeve 16. The force imparted on the dowel sleeve 16 by the bushing 14 mitigates movement, both axial and rotational, of the dowel sleeve 16 relative to the bushing 14.

With the dowel placement system 10 in place, the concrete 50 is poured into the pour area 22 (see FIG. 5), which preferably embeds the dowel sleeve 16 within the concrete 50. After the concrete 50 is poured, it is allowed to harden.

Figure 6:
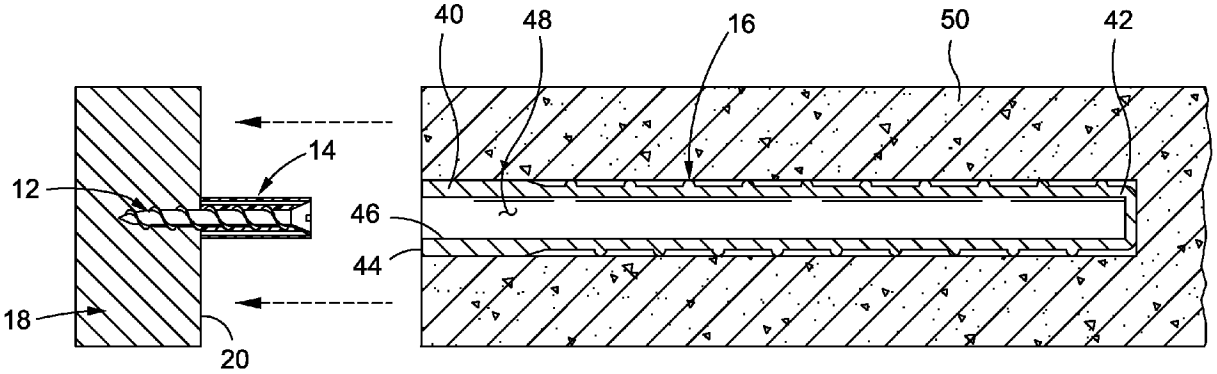
FIG. 6 is a side sectional view of the form and bushing removed from the poured concrete and the embedded dowel sleeve.
Figure 7:
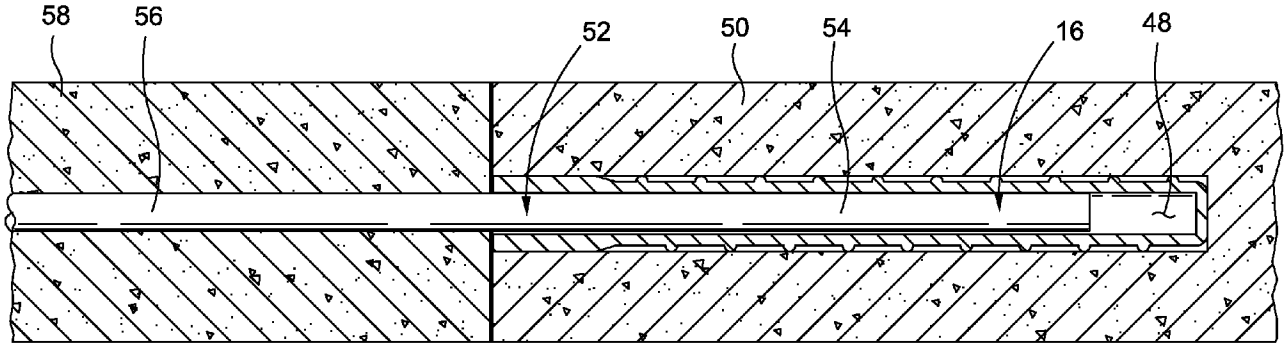
FIG. 7 is a side sectional view of a dowel extending between two separately poured sections of concrete, with the dowel extending within the dowel sleeve in one of the concrete sections.

After the concrete 50 has hardened, the form 18 is stripped and removed from the concrete 50 (see FIG. 6). Since the fastener 12 is still engaged with the form 18, the process of stripping the form 18 simultaneously removes the bushing 14 from the dowel sleeve 16. The end face 44 of the dowel sleeve 16 and the axial opening 48 are exposed after the form 18 is stripped and the bushing 14 is removed.

A slip dowel 52 is inserted into the axial opening 48, such that a first portion 54 of the slip dowel 52 resides within the axial opening 48 and an opposing second portion 56 of the slip dowel 52 extends out of the axial opening 48. Conventional slip dowels 52 are typically made in ½ inch or ¾ inch diameters, although other slip dowels 52 known in the art may also be used. A second concrete slab 58 is poured adjacent the first concrete slap 50, with the second portion 56 of the slip dowel 52 being embedded within the second concrete slab 58. As the second concrete slab 58 hardens, the second portion 56 of the slip dowel 52 becomes affixed to the second concrete slab 58. In contrast, the first portion 54 is axially moveable within the opening 48, which allows the first and second concrete slabs to axially move relative to each other within a common plane. In other words, since the slip dowel 52 extends between the first and second concrete slabs 50, 58, the dowel 52 mitigates vertical movement of one slab relative to the other, while allowing horizontal movement between the slabs 50, 58.

As noted above, the dowel placement system 10 is an improvement on many existing dowel placement devices due to the unique engagement between the dowel sleeve 16 and the bushing 14. The secure engagement therebetween maintains the dowel sleeve 16 in a properly aligned position during formation of the concrete structure and does not require the dowel sleeve to include a flange for stabilizing and supporting the dowel sleeve 16 upon the form 18, as is customary in the trade. In this regard, the dowel sleeve 16 may be formed with less material and may be more easily positioned prior to pouring the concrete.

Figure 8:
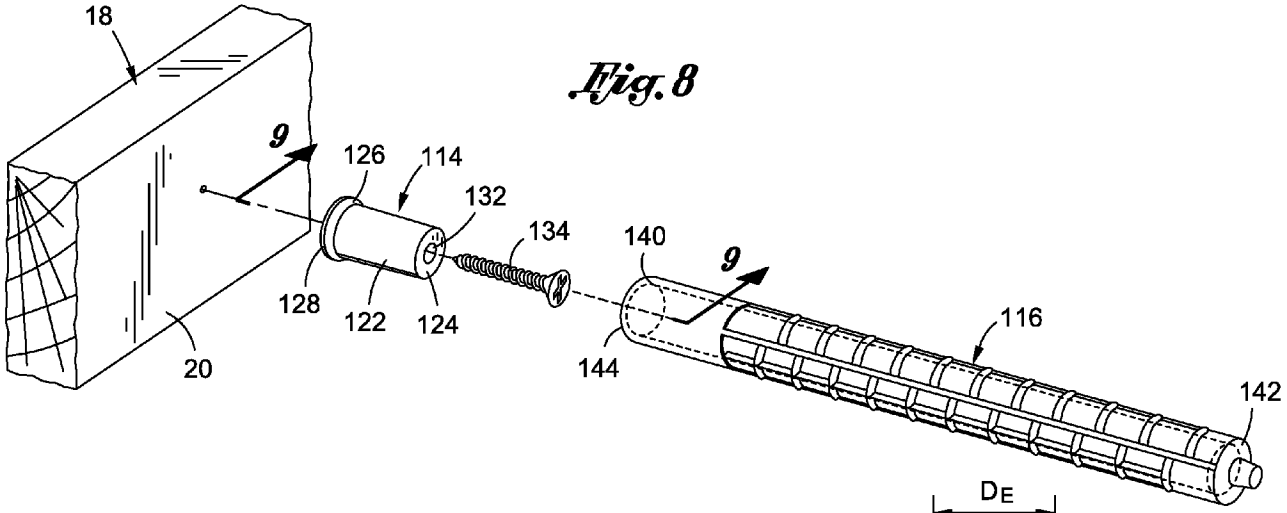
FIG. 8 is an upper perspective view of another embodiment of a dowel placement system.
Figure 10:
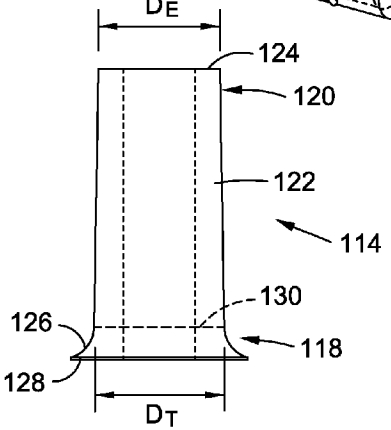
FIG. 10 is a side view of the bushing shown in FIGS. 8 and 9.
Figure 9:
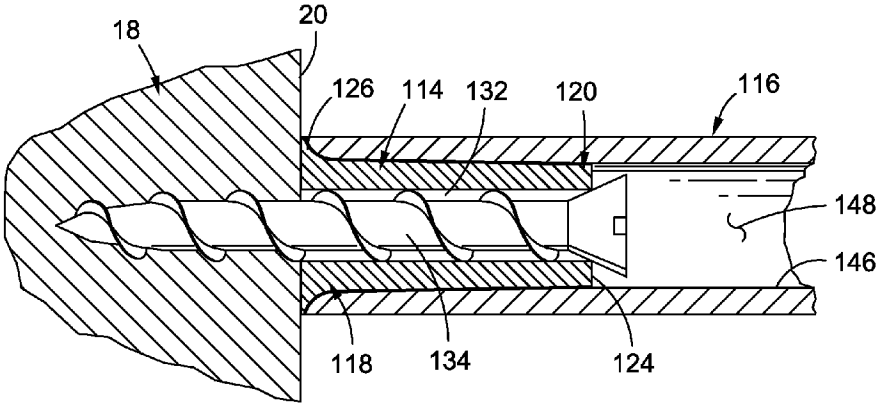
FIG. 9 is a cross sectional view of a bushing advanced within a dowel sleeve as used in the dowel placement system depicted in FIG. 8.

Referring now to FIGS. 8-10, there is shown a dowel placement system 110 constructed in accordance with another embodiment of the present invention, which generally includes a bushing 114 and a dowel sleeve 116. The primary distinction between the dowel placement system 110 shown in FIGS. 8-10 and the dowel placement system 10 shown in FIGS. 1-7 and discussed above relates to the configuration of the bushing 114, as will be discussed in more detail below.

The bushing 114 includes a first end portion 118 and an opposed second end portion 120. A cylindrical, externally tapered shaft 122 extends from a shaft end face 124, formed at the second end portion 120, toward the first end portion 118. The diameter of the shaft slightly increases in a direction from the second end portion 120 toward the first end portion 118. The bushing 114 transitions from the shaft 122 to a slight flange or fillet 126 formed adjacent the first end portion 118. The flange 118 terminates at a flange end face 128, which is positioned against the concrete form 18 during use of the bushing 114, as will be described in more detail below.

The transition from the tapered shaft 122 to the slight flange 128 may be defined by a modification in the rate of change of the diameter of the bushing 114. In particular, the shaft portion 122 of the bushing 114 preferably includes a linear taper, whereas the flange portion 128 includes curved/concave taper. FIG. 10 shows a transitional diameter 130 having a magnitude, "$D_T$," with the linear shaft portion 122 shown above the transitional diameter 130 and the curved fillet portion 126 shown below the transitional diameter 130.

According to one embodiment, the difference between the magnitude $D_T$ of the transitional diameter 130 and the magnitude $D_E$ of the diameter of the shaft end face 124 is approximately 0.002 inches, with appropriate allowances given to manufacturing tolerances. Of course, the difference in magnitude ($D_T$-$D_E$) may be greater than 0.002 inches or less than 0.002 inches without departing from the spirit and scope of the present invention.

The bushing 114 may be formed from a wide range of materials, including stainless steel, or other metals, plastics or other materials known in the art. Preferably, the bushing 114 is fabricated from a material known in the art which allows the bushing 114 to be reused for several years.

The dowel sleeve 116 includes a proximal end portion 140 and an opposing distal end portion 142. An end face 144 is formed at the proximal end portion 140, and an inner surface 146 extends from the end face 144 toward the distal end portion 142 to define an axial opening 148 within the dowel sleeve 116. The dowel sleeve 116 is structurally similar to the dowel sleeve 16 discussed above, and therefore, for a more comprehensive discussion of the dowel sleeve 116, please refer to the foregoing description of dowel sleeve 16.

Usage of the dowel placement system 110 generally includes securing the bushing 114 to the concrete form 18 prior to pouring of the concrete. The bushing 114 may be secured to the form 18 through the use of a screw 134, nail, rivet or other mechanical fastener known in the art. According to one embodiment, the bushing 114 includes longitudinal opening 132 extending through the bushing 114 from the shaft end face 124 to the flange end face 128 to accommodate the mechanical fastener 134. When the bushing 114 is secured to the form 18, the flange end face 128 is placed in opposed, abutting relation with the inner face 20 of the form 18. The slightly enlarged diameter of the flange 126 provides stability to the bushing 114 and mitigates tipping or rocking of the bushing 114 relative to the form 18.

With the bushing 114 secured to the form 20, the dowel sleeve 116 is advanced over the shaft 122 of the bushing 114. The tapered diameter of the shaft 122 allows the dowel sleeve 116 to be easily advanced over the shaft 122, as the diameter $D_E$ of the shaft end face 124 is preferably smaller than the inner diameter of the opening 148 of the dowel sleeve 116. As the dowel sleeve 116 is advanced over the bushing 114, a frictional engagement is preferably formed between the bushing 114 and the dowel sleeve 116. In this regard, the transitional diameter $D_T$ is preferably substantially equal to the inner diameter of the sleeve opening 148 to allow for such frictional engagement. The frictional engagement between the bushing 114 and the dowel sleeve 116 is preferably strong enough to maintain the dowel sleeve 116 in a desired position when pouring the concrete. In this regard, the dowel sleeve 116 may be formed from a resilient material, such as rubber, plastic or other materials known in the art which would allow the dowel sleeve 116 to slightly expand to conform to the dimensions of the bushing 114 for creating the frictional engagement therebetween.

When the dowel sleeve 116 is completely advanced over the bushing 114, the bushing flange 126 preferably extends at least partially between the end face 144 of the dowel sleeve 116 and the inner face 20 of the form 18. In this respect, the flange 126 may extend completely between the end face 144 and the inner face 20, such that the end face 144 does not contact the inner face 20, or alternatively, the flange 126 may extend only partially between the dowel sleeve 116 and the inner face 20, such that a peripheral portion of the end face 144 contacts the inner face 20 of the form 18.

With the dowel sleeve 116 secured to the bushing 114, the concrete is poured in the form 20 and the bushing dowel sleeve 116 is covered by the concrete. The concrete is allowed to settle and harden, after which time the form 18 is stripped from the hardened concrete. When the form 20 is stripped from the concrete, the bushing 114 is pulled out of the sleeve opening 148. The tapered diameter of the bushing shaft 122 allows the bushing 114 to be easily removed from the sleeve opening 148.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A dowel placement system for placing dowels in a concrete structure fabricated using a form, the dowel placement system comprising:

a fastener configured to be engageable with the form;

a bushing having a shaft and a flange disposed adjacent one end of the shaft, the shaft having a continuously decreasing diameter in a direction away from the flange; and an elongate dowel sleeve having an outer diameter, a proximal end portion, an opposing distal end portion, and an axial opening having an inner diameter and extending into the dowel sleeve from the proximal end portion to the distal end portion;

the bushing being insertable within the axial opening of the dowel sleeve, the bushing and dowel sleeve being configured such that insertion of the bushing within the dowel sleeve creates a friction force between the bushing and the dowel sleeve to mitigate movement of the dowel sleeve relative to the bushing during formation of the concrete structure; and wherein an outer diameter of the flange of the bushing is less than the outer diameter of the elongate dowel sleeve.

2. The dowel placement system recited in claim 1, wherein the shaft defines a maximum shaft diameter and a minimum shaft diameter approximately 0.002 inches smaller than the maximum shaft diameter.

* * * * *